US012569043B2

(12) United States Patent
Zhang

(10) Patent No.: US 12,569,043 B2
(45) Date of Patent: Mar. 10, 2026

(54) LOCKING DEVICE AND SUITCASE HAVING SAME

(71) Applicant: Xiaoyi Zhang, Xiamen (CN)

(72) Inventor: Xiaoyi Zhang, Xiamen (CN)

( * ) Notice: Subject to any disclaimer, the term of this patent is extended or adjusted under 35 U.S.C. 154(b) by 513 days.

(21) Appl. No.: 18/260,045

(22) PCT Filed: Feb. 23, 2021

(86) PCT No.: PCT/CN2021/077329
§ 371 (c)(1),
(2) Date: Jun. 30, 2023

(87) PCT Pub. No.: WO2021/175127
PCT Pub. Date: Sep. 10, 2021

(65) Prior Publication Data

US 2024/0164500 A1 May 23, 2024

(30) Foreign Application Priority Data

Mar. 5, 2020 (CN) ..... 202020259586.4

(51) Int. Cl.
*A45C 13/10* (2006.01)
*A45C 5/03* (2006.01)
*A45C 7/00* (2006.01)

(52) U.S. Cl.
CPC ..... *A45C 13/10* (2013.01); *A45C 5/03* (2013.01); *A45C 7/0018* (2013.01)

(58) Field of Classification Search
CPC ..... A45C 13/10; A45C 5/03; A45C 7/0018
USPC ..... 190/119
See application file for complete search history.

(56) References Cited

U.S. PATENT DOCUMENTS 6,061,871 A 5/2000 Wang
6,223,391 B1 5/2001 Kuo
7,874,409 B1 * 1/2011 Lakhal ..... A45C 7/00 190/103
2003/0014841 A1 * 1/2003 Kuo ..... A45C 13/262 16/405

(Continued)

FOREIGN PATENT DOCUMENTS

CN 2352033 Y 12/1999
CN 2408745 Y 12/2000
CN 2413553 Y 1/2001

(Continued)

*Primary Examiner* — Nathan J Jenness
*Assistant Examiner* — Jessica Kavini Tamil
(74) *Attorney, Agent, or Firm* — Bayramoglu Law Offices LLC

(57) ABSTRACT

A locking device includes a housing, a locking base, a locking mechanism and a linkage mechanism. The locking base is provided with a receiving cavity. The locking mechanism includes a locking pin and a first spring. The locking pin is arranged in the receiving cavity. The first spring abuts the locking pin. The linkage mechanism includes a button, a pull rope and a thrust member. The button is arranged on the housing. The lower end of the pull rope is connected to the button, and the upper end of the pull rope is connected to the thrust member. An end of the locking pin is retracted into or stretched out of the receiving cavity by the thrust member. A size-adjustable suitcase including the locking device, an upper case body and a lower case body is further provided.

14 Claims, 12 Drawing Sheets

(56) References Cited

U.S. PATENT DOCUMENTS

| | | | | |
|---|---|---|---|---|
| 2006/0225981 | A1* | 10/2006 | Lin | A45C 13/262<br>16/113.1 |
| 2008/0142322 | A1* | 6/2008 | Barker | A45C 9/00<br>220/4.03 |

FOREIGN PATENT DOCUMENTS

| | | | |
|---|---|---|---|
| CN | 2422856 | Y | 3/2001 |
| CN | 2433861 | Y | 6/2001 |
| CN | 206275306 | U | 6/2017 |
| CN | 208114187 | U | 11/2018 |
| CN | 209518411 | U | 10/2019 |
| CN | 211581840 | U | 9/2020 |

* cited by examiner

LOCKING DEVICE AND SUITCASE HAVING SAME

CROSS REFERENCE TO THE RELATED APPLICATIONS

This application is the national phase entry of International Application No. PCT/CN2021/077329, filed on Feb. 23, 2021, which is based upon and claims priority to Chinese Patent Application No. 202020259586.4, filed on Mar. 5, 2020, the entire contents of which are incorporated herein by reference.

TECHNICAL FIELD

The present invention relates to the technical field of daily necessities, and more particularly, to a locking device and a suitcase having the same.

BACKGROUND

Cases are typically divided into expandable cases and non-expandable cases. For non-expandable cases, the size of the internal usable space of a case is fixed, and the storage space of the case cannot be changed according to the actual need. Moreover, the use frequency of the case (especially the suitcase) is relatively low, and the case is often left aside, so the non-expandable case needs a certain space for placement, which is not convenient for storage.

For expandable cases, the internal storage space of a case can be changed according to the actual storage need, so as to make the case more practical. However, for current expandable cases, a detachable case is typically added and connected to the original case by a locking structure. For example, the patent No. CN208114187U entitled "Size-Adjustable Suitcase" discloses that a movable case body is connected to a top case body and a bottom case body through a zipper-based locking structure, but such a connection is not convenient and labor-saving in practical use.

SUMMARY

An objective of the present invention is to provide a locking device and a suitcase having the same. The operation of the locking device is convenient and labor-saving, and it is convenient to adjust the size of the suitcase according to the actual need.

In order to achieve the above objective, the present invention adopts the following technical solutions:

A locking device includes a hollow housing, a locking base, a locking mechanism and a linkage mechanism. The locking base is provided with a receiving cavity. The locking mechanism includes a locking pin and a first spring. The locking pin is arranged in the receiving cavity, and the first spring is arranged in the receiving cavity and abuts the locking pin. The linkage mechanism includes a button, a pull rope and a thrust member. The button is arranged on the housing. The lower end of the pull rope is connected to the button, and the upper end of the pull rope is connected to the thrust member. An end of the locking pin is retracted into or stretched out of the receiving cavity by the thrust member.

Preferably, a connection base is arranged on the back of the button, and a hinge is rotatably arranged on the connection base. The lower end of the pull rope is rotatably connected to the hinge.

Preferably, an end portion of the lower end of the pull rope is provided with a lower connection head, and the lower connection head is rotatably connected to the hinge. The lower connection head is provided with a first stopping piece. An extension portion is formed on a side of the housing, and the extension portion is provided with a groove communicated with the interior of the housing. The groove is provided with a positioning groove in a length direction of the groove, and the lower connection head passes through the groove to allow the first stopping piece to move along the positioning groove.

Preferably, the locking base includes a first base body and a second base body. The first base body is provided with a mounting groove and a mounting hole, and the thrust member is arranged in the mounting groove. The upper end of the pull rope passes through the mounting hole and is then connected to the thrust member. A side of the first base body extends to form the second base body. The second base body is provided with the receiving cavity, and the receiving cavity is communicated with the mounting groove.

Preferably, the locking pin includes a pin body and a top stopping portion. The top of the pin body is provided with a thrust opening, and the thrust member abuts the thrust opening. A side of the pin body extends to form the top stopping portion.

Preferably, the cross-sectional shape of the thrust opening is triangular. The shape of the lower end of the thrust member is adapted to the shape of the thrust opening. Sides of the thrust member extend respectively to form a second stopping piece and a connection portion. The side of the first base body adjacent to the second base body is provided with a limiting groove, and the second stopping piece moves in the limiting groove. The pull rope passes through the connection portion movably, and the top end of the pull rope is provided with an upper connection head.

Preferably, sides of the first base body extend to form a plurality of second base bodies, and the first base body is provided with mounting grooves corresponding to the second base bodies in number. The plurality of second base bodies are respectively provided with receiving cavities, and the receiving cavities are respectively communicated with the mounting grooves. Locking pins and first springs are arranged in the receiving cavities. The number of thrust members corresponds to the number of second base bodies. Connection portions of the thrust members are connected to form an integrated part, and the thrust members respectively abut thrust openings of the locking pins.

Preferably, the front side of the housing is provided with a mounting opening for mounting the button, and the rear side of the housing is provided with a housing cover for closing the housing. A plurality of columns are arranged in the housing, and the housing cover is fixed on the columns.

A suitcase includes a lower case body, an upper case body and the aforementioned locking device. The lower case body is provided with a lower locking hole, and the upper case body is provided with at least two upper locking holes in a plane where the lower locking hole is located. The locking device is arranged on the inner side wall of the lower case body. The locking pin of the locking device passes through the lower locking hole and then is inserted into one of the upper locking holes to connect the lower case body and the upper case body together.

Further, a slide rail is arranged on the lower case body, and the slide rail is arranged along the height direction of the lower case body. A slider is arranged on the inner side of the upper case body, and the slider is adapted to the slide rail.

After adopting the above technical solutions, compared with the background technology, the present invention has the following advantages:

1. In the present invention, the pull rope is driven by pressing the button to allow an end of the locking pin to be retracted into the receiving cavity through the thrust member. After the button is released, the locking pin stretches out of the receiving cavity under the action of the thrust member and the first spring to realize the locking role. The operation of the locking device is very convenient and labor-saving.

2. In the present invention, a plurality of second base bodies are formed on the locking base, and the second base bodies are respectively provided with locking pins and first springs. The locking pins are respectively controlled by an integrated thrust member to be stretched or retracted, so that the locking pins can simultaneously realize the locking role to ensure the locking reliability.

3. In the present invention, the height of the upper case body can be adjusted according to the actual need to change the size of the suitcase, and then the lower case body and the upper case body are connected together through the locking device. In this way, the suitcase can meet the different requirements of use and placement respectively, and it is very convenient to adjust the size of the suitcase.

REFERENCE NUMBERS IN THE FIGURES

Figure 1:
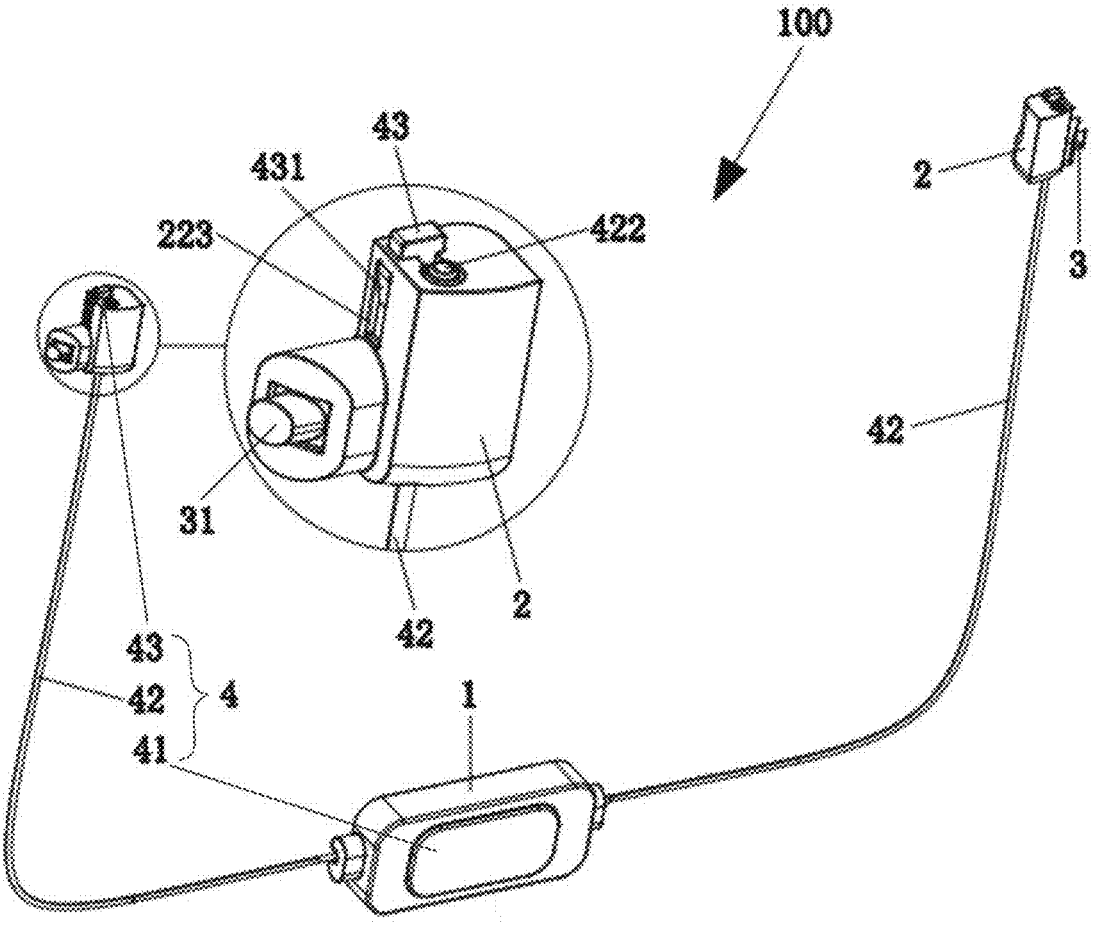
FIG. 1 is a perspective view of Embodiment 1 of the present invention.

100 locking device, 1. housing, 11. mounting opening, 12. housing cover, 13. column, 14. extension portion, 141. groove, 142. positioning groove, 2. locking base, 21. receiving cavity, 22. first base body, 221. mounting groove, 222. mounting hole, 223. limiting groove, 23. second base body, 3. locking mechanism, 31. locking pin, 311. pin body, 3111. thrust opening, 312. top stopping portion, 32. first spring, 4. linkage mechanism, 41. button, 411. connection base, 42. pull rope, 421. lower connection head, 4211. first stopping piece, 422. upper connection head, 43. thrust member, 431. second stopping piece, 432. connection portion, 44. hinge, 45. second spring,

200. lower case body, 210. lower locking hole, 220. slide rail, and

300. upper case body, 310. upper locking hole, 320. slider.

DETAILED DESCRIPTION OF THE EMBODIMENTS

In order to make the objective, technical solution and advantages of the present invention clear, the present invention is further described in detail below in conjunction with the drawings and embodiments. It should be understood that the specific embodiments described herein are used only to explain the present invention and are not used to limit the present invention.

It should be noted in the present invention that the terms "up", "down", "left", "right", "vertical", "horizontal", "inner", "outer" and the like are all based on the orientation or position relationship shown in the drawings, only for facilitating the description of the present invention and simplifying the description, rather than indicating or implying that the device or element of the present invention must have a specific orientation, so they cannot be understood as a limitation to the present invention.

Embodiment 1

Referring to FIG. 1, the present invention discloses the locking device 100, including the hollow housing 1, the locking base 2, the locking mechanism 3 and the linkage mechanism 4.

Figure 2:
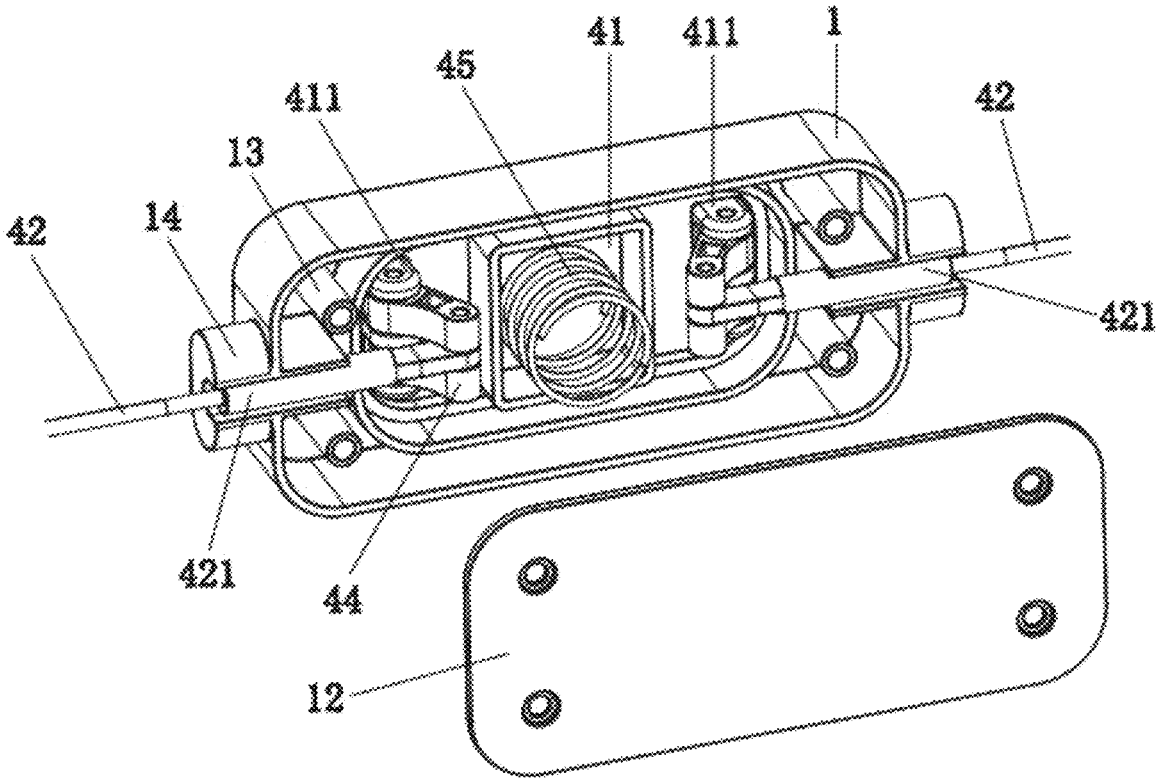
FIG. 2 is a schematic diagram of the partial structure of a linkage mechanism in Embodiment 1 of the present invention.
Figure 3:
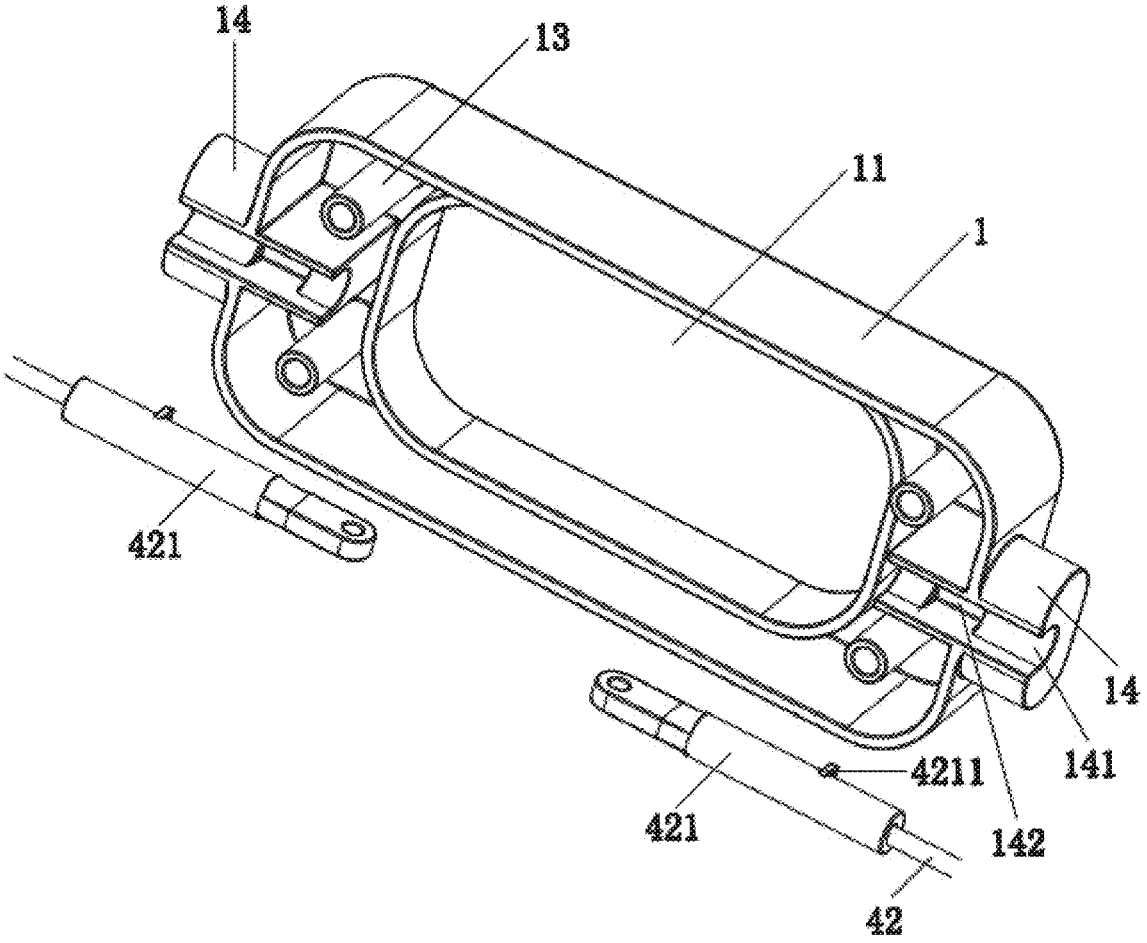
FIG. 3 is a schematic diagram of the structure of a housing in Embodiment 1 of the present invention.

As shown in FIGS. 1-3, the front side of the housing 1 is provided with the mounting opening 11 for mounting the button 41, and the rear side of the housing 1 is provided with the housing cover 12 for closing the housing 1. A plurality of columns 13 are arranged in the housing 1, and the housing cover 12 is fixed on the columns 13. The extension portion 14 is formed on a side of the housing 1, and the extension portion 14 is provided with the groove 141 communicated with the interior of the housing 1. The groove 141 is provided with the positioning groove 142 in the length direction of the groove 141.

Figure 4:
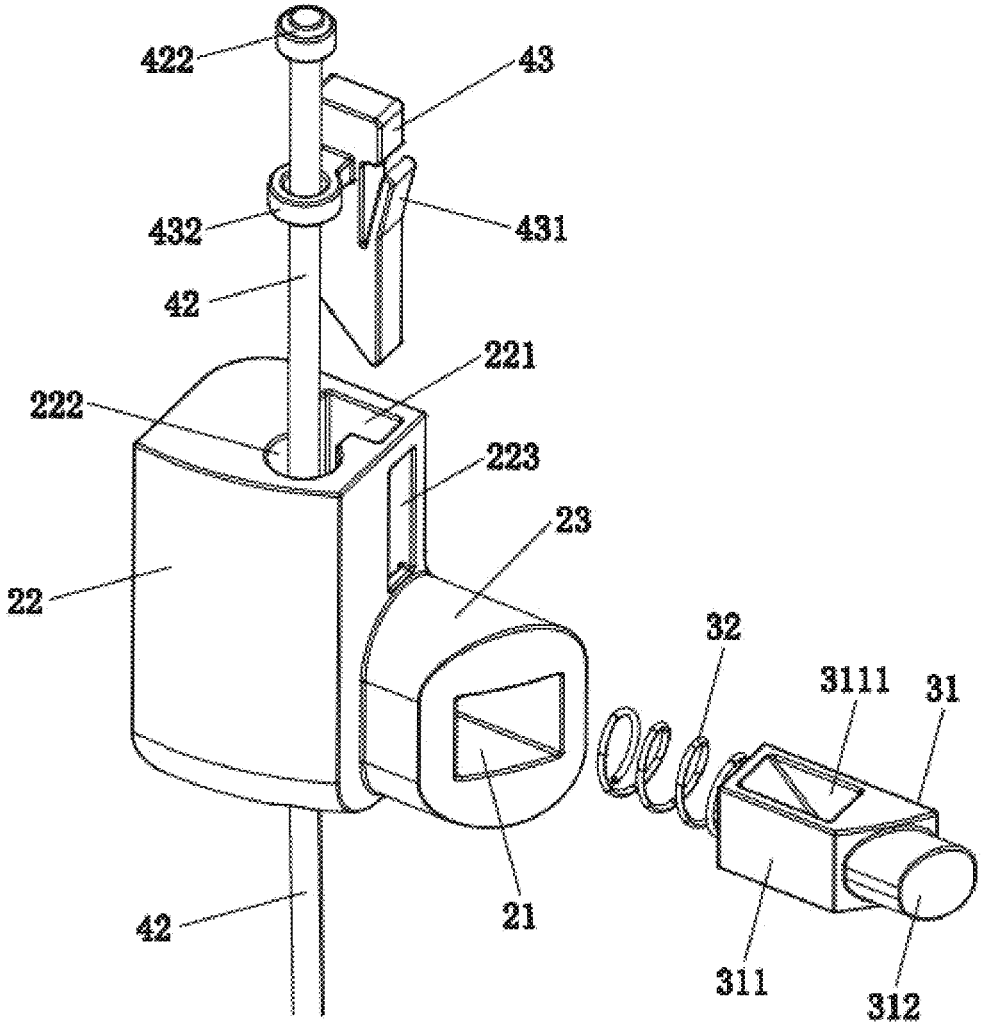
FIG. 4 is an exploded view of the partial structure in Embodiment 1 of the present invention.
Figure 5:
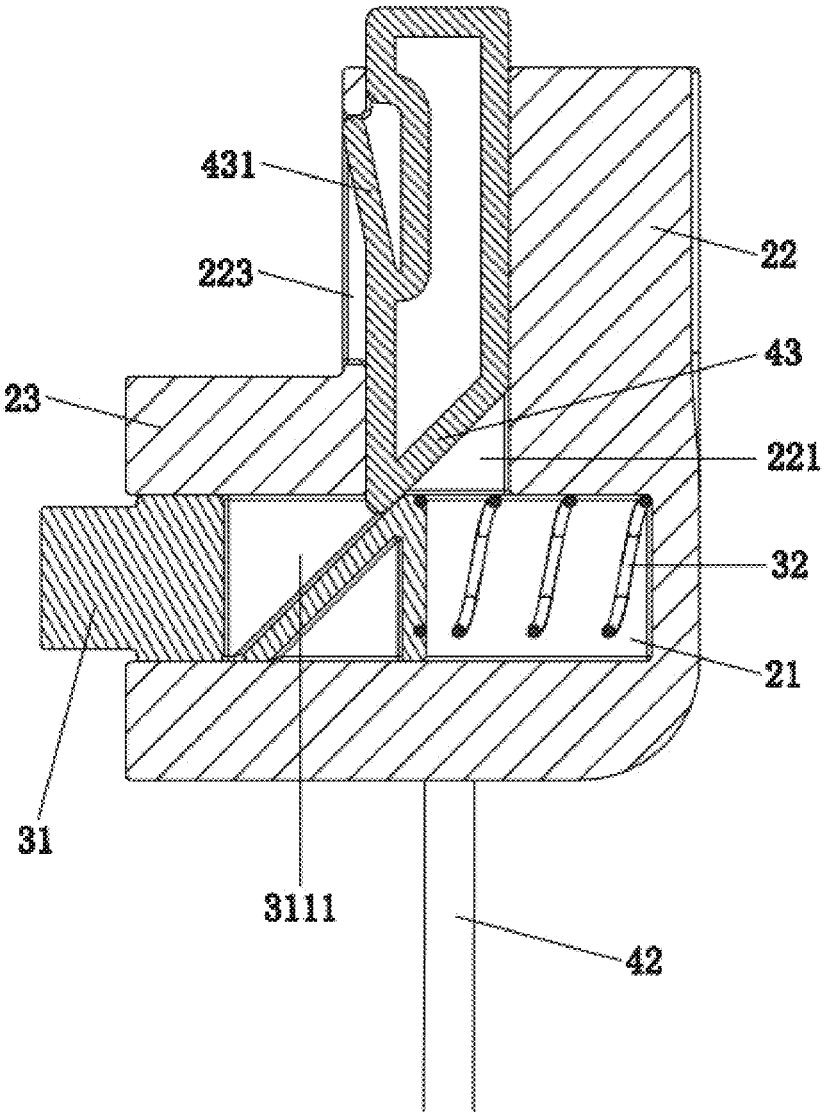
FIG. 5 is a cross-sectional view of the partial structure in Embodiment 1 of the present invention.

As shown in FIGS. 1, 4 and 5, the locking base 2 is provided with the receiving cavity 21, and the locking base 2 includes the first base body 22 and the second base body 23. The first base body 22 is provided with the mounting groove 221 and the mounting hole 222. A side of the first base body 22 adjacent to the second base body 23 is provided with the limiting groove 223, and the side of the first base body 22 extends to form the second base body 23. The second base body 23 is provided with the receiving cavity 21, and the receiving cavity 21 is communicated with the mounting groove 221.

The locking mechanism 3 includes the locking pin 31 and the first spring 32. The locking pin 31 is arranged in the receiving cavity 21, and the first spring 32 is arranged in the receiving cavity 21 and abuts the locking pin 31. The locking pin 31 includes the pin body 311 and the top stopping portion 312. The top of the pin body 311 is provided with the thrust opening 3111. In the present embodiment, the cross-sectional shape of the thrust opening 3111 is triangular, and a side of the pin body 311 extends to form the top stopping portion 312.

As shown in FIGS. 1-5, the linkage mechanism 4 includes the button 41, the pull rope 42 and the thrust member 43. The button 41 is arranged on the housing 1. The lower end of the pull rope 42 is connected to the button 41, and the upper end of the pull rope 42 is connected to the thrust member 43. An end of the locking pin 31 is retracted into or stretched out of the receiving cavity 21 by the thrust member 43.

The connection base 411 is arranged on the back of the button 41, and the hinge 44 is rotatably arranged on the connection base 411. The lower end of the pull rope 42 is rotatably connected to the hinge 44, and the button 41 is reset by the second spring 45.

The upper end of the pull rope 42 passes through the mounting hole 222 of the locking base 2 and is then connected to the thrust member 43. An end portion of the lower end of the pull rope 42 is provided with the lower connection head 421, and the lower connection head 421 is rotatably connected to the hinge 44. The lower connection head 421 is provided with the first stopping piece 4211, and the lower connection head 421 passes through the groove 141 to allow the first stopping piece 4211 to move along the positioning groove 142. The length of the groove 141 is approximately adapted to the moving distance of the top stopping portion 312, so that the button 41 is pressed by one stroke to allow the top stopping portion 312 to be retracted into the receiving cavity 21. In the present embodiment, the pull rope 42 is a rigid rope. Moreover, in order to ensure the stability and accuracy during pulling, a limiting piece (not shown in the figure) is arranged along the rope arrangement direction of the pull rope 42, and the pull rope 42 movably passes through the limiting piece, so that the pull rope 42 is prevented from shaking or shifting during pulling.

The thrust member 43 is arranged in the mounting groove 221 and abuts the thrust opening 3111 of the pin body 311. The shape of the lower end of the thrust member 43 is adapted to the shape of the thrust opening 3111. In the present embodiment, the cross-sectional shape of the thrust opening 3111 is preferably a right triangle, so that the thrust member 43 moves in the thrust opening 3111 accurately. The sides of the thrust member 43 extend respectively to form the second stopping piece 431 and the connection portion 432. The second stopping piece 431 moves in the limiting groove 223 to prevent the thrust member 43 from separating from the thrust opening 3111. The connection portion 432 is provided with a through hole. The pull rope 42 passes through the connection portion 432 movably, and the top end of the pull rope 42 is provided with the upper connection head 422.

In the present invention, at least two locking bases 2 and at least two locking mechanisms 3 are arranged. The button 41 is connected to a plurality of pull ropes 42, and the upper end of each of the pull ropes 42 is connected to the thrust member 43 to realize the locking role of each of the locking mechanisms 3. Preferably, in the present embodiment, two locking bases 2 and two locking mechanisms 3 are arranged. The button 41 is connected to two pull ropes 42. The upper ends of the two pull ropes 42 are respectively connected to the thrust members 43, and the two pull ropes 42 can operate synchronously to pull the thrust members 43 respectively, so that an end of the locking pin 31 is retracted into or stretched out of the receiving cavity 21. The two locking mechanisms 3 work collaboratively to realize the locking role, and ensure the locking reliability.

Embodiment 2

Figure 6:
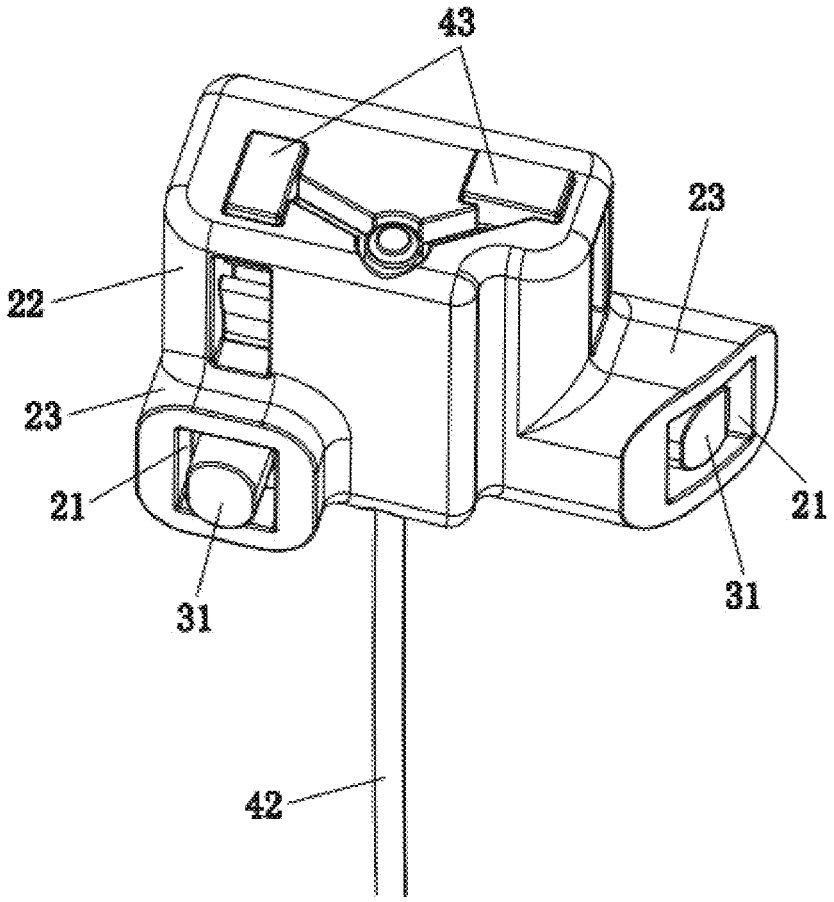
FIG. 6 is a schematic diagram of the partial structure in Embodiment 2 of the present invention.
Figure 7:
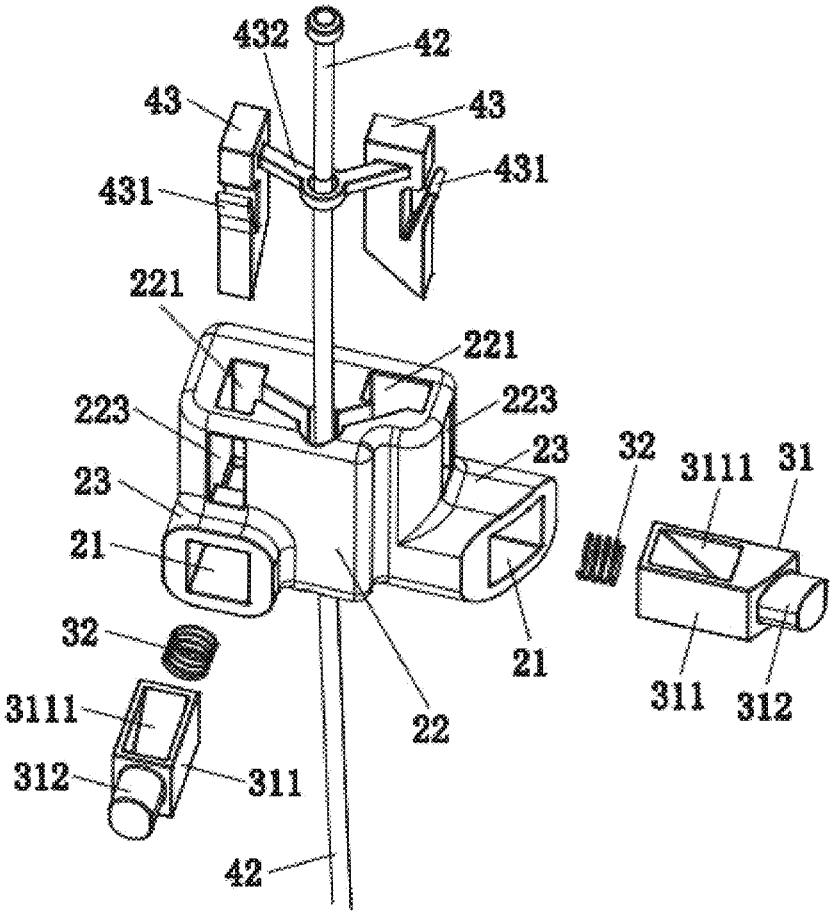
FIG. 7 is an exploded view of the structure in FIG. 6.
Figure 8:
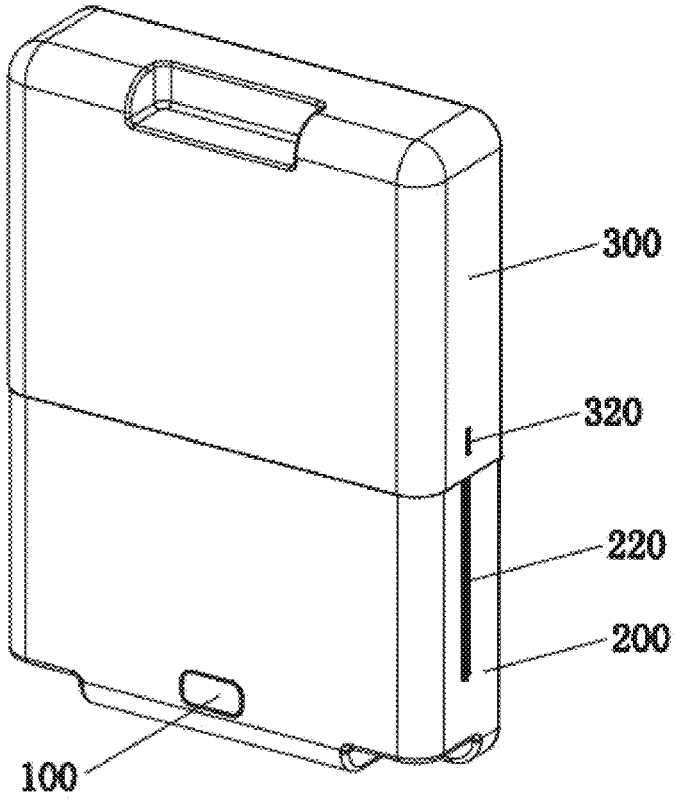
FIG. 8 is a first perspective view of the structure (in an unfolded state) in Embodiment 3 of the present invention.
Figure 9:
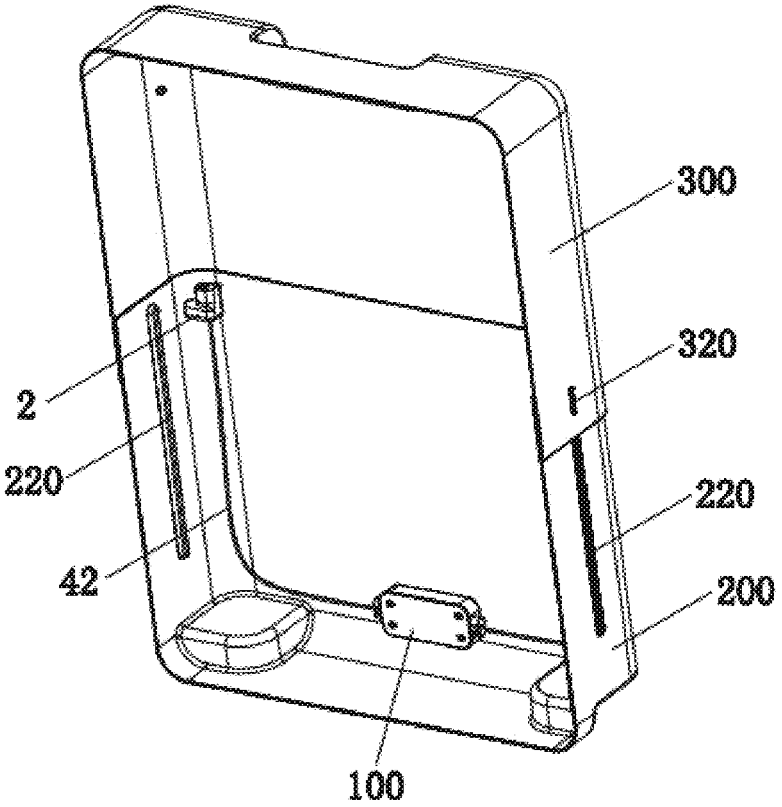
FIG. 9 is a second perspective view of the structure (in the unfolded state) in Embodiment 3 of the present invention.
Figure 10:
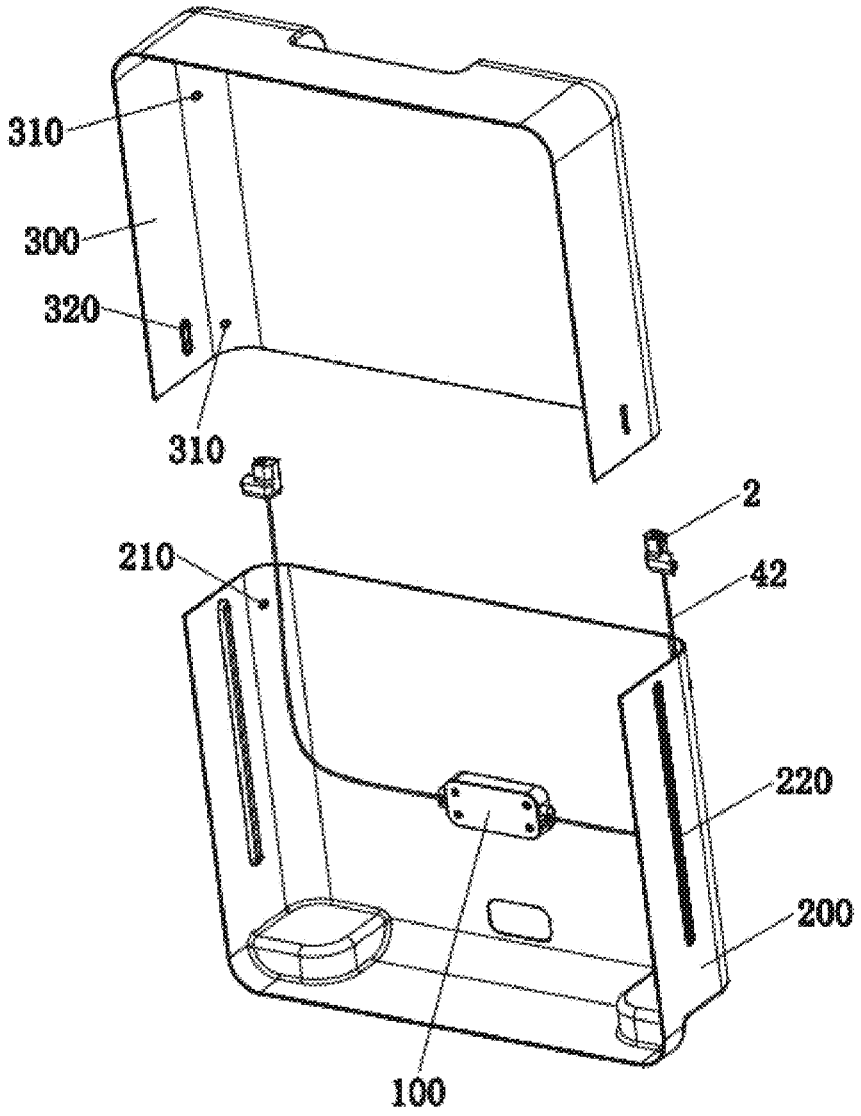
FIG. 10 is an exploded view of the structure in FIG. 9.
Figure 11:
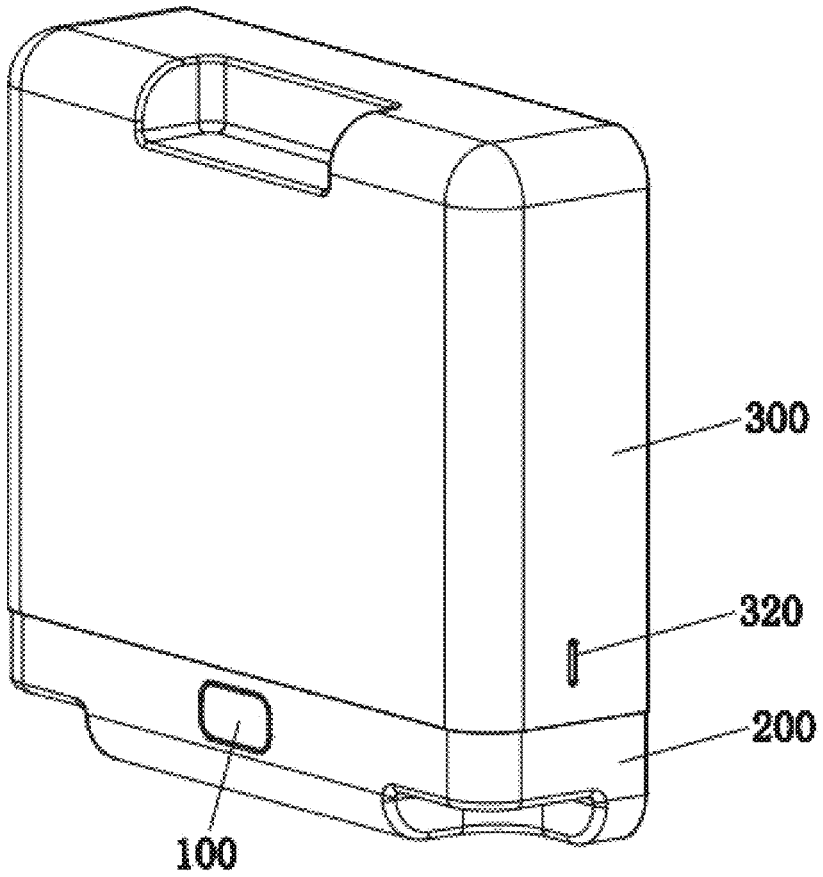
FIG. 11 is a third perspective view of the structure (in a folded state) in Embodiment 3 of the present invention.
Figure 12:
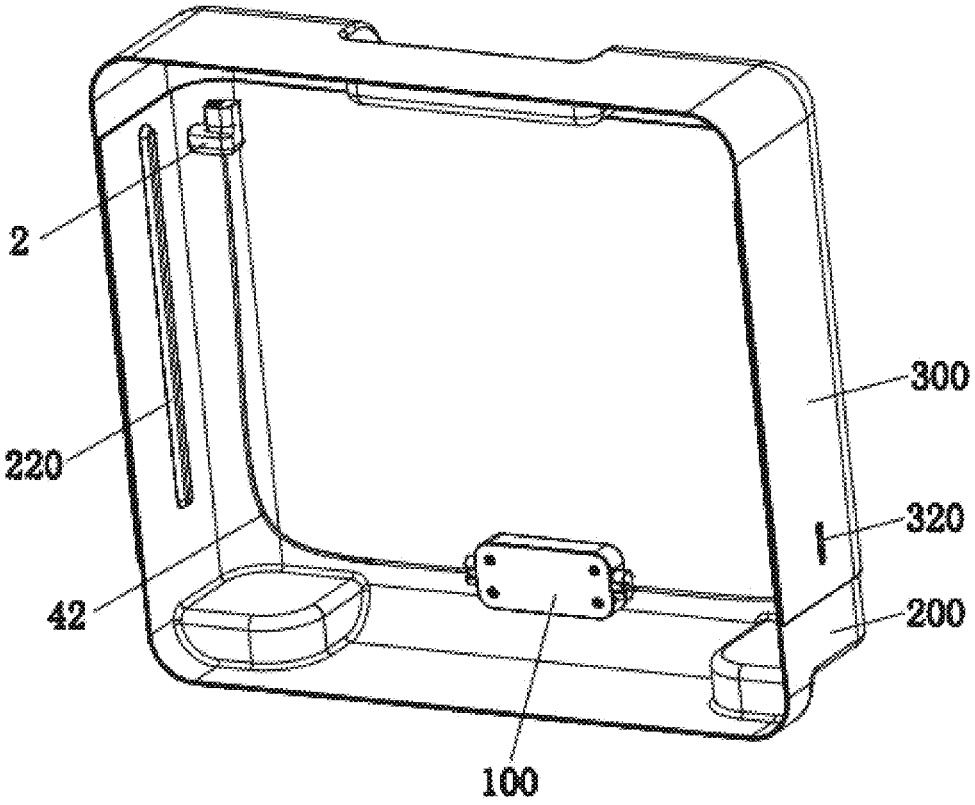
FIG. 12 is a fourth perspective view of the structure (in the folded state) in Embodiment 3 of the present invention.

As shown in FIGS. 1, 6 and 7, the present embodiment has the following differences from Embodiment 1:

The sides of the first base body 22 extend to form a plurality of second base bodies 23, and the first base body 22 is provided with mounting grooves 221 corresponding to the plurality of the second base bodies 23 in number. The plurality of second base bodies 23 are respectively provided with the receiving cavities 21. The receiving cavities 21 are respectively communicated with the mounting grooves 221. The locking pins 31 and the first springs 32 are arranged in the receiving cavities 21. The number of thrust members 43 corresponds to the number of second base bodies 23. The connection portions 432 of the thrust members 43 are connected to form an integrated part. The thrust members 43 respectively abut the thrust openings 3111 of the locking pins 31.

In the present embodiment, preferably, the sides of the first base body 22 extend to form two second base bodies 23, and two thrust members 43 are arranged. The connection portions 432 of the two thrust members 43 are connected to form an integrated part. The two thrust members 43 respectively abut the thrust openings 3111 of the locking pins 31. The pull rope 42 can pull the thrust members 43 simultaneously, so that one end of each of the locking pins 31 is retracted into or stretched out of the receiving cavities 21. In this way, the locking pins 31 can work collaboratively to realize the locking role and further ensure the locking reliability.

Embodiment 3

As shown in FIGS. 1 and 8-12, the present invention further discloses a suitcase, including the lower case body 200, the upper case body 300 and the aforementioned locking device 100. The lower case body 200 is provided with the lower locking hole 210. The upper case body 300 is provided with at least two upper locking holes 310 in the plane where the lower locking hole 210 is located. The locking device 100 is arranged on the inner side wall of the lower case body 200. The locking pin 31 of the locking device 100 passes through the lower locking hole 210 and then is inserted into one of the upper locking holes 310 to connect the lower case body 200 and the upper case body 300 together.

In the present embodiment, the slide rail 220 is arranged on the lower case body 200, and the slide rail 220 is arranged along the height direction of the lower case body 200. The slider 320 is arranged on the inner side of the upper case body 300, and the slider 320 is adapted to the slide rail 220. When the upper case body 300 is moved relative to the lower case body 200, the slider 320 and the slide rail 220 cooperate with each other, so that the stability of the connection between the upper case body 300 and the lower case body 200 is improved, and the top stopping portion 312 is aligned with the upper locking hole 310 more accurately.

The working principle of the present invention is as follows:

When the suitcase is not adjusted, the first spring 32 is compressed, so that the locking pin 31 is stretched out of the outer side of the receiving cavity 21. Moreover, since the second stopping piece 431 of the thrust member 43 is restricted by the limiting groove 223, the lower end of the thrust member 43 is pressed against the position adjacent to the top of the thrust opening 3111 to limit the length of the locking pin 31 stretching outward, so that the top stopping portion 312 of the locking pin 31 is exposed out of the receiving cavity 21. At this time, the top stopping portion 312 stretching outward passes through the lower locking hole 210 of the lower case body 200 and then is inserted into one of the upper locking holes 310 of the upper case body 300 to connect the lower case body 200 and the upper case body 300 together.

When the height of the suitcase needs to be adjusted, the button 41 is first pressed, so that the upper case body 300 can move up and down relative to the lower case body 200. Then, the lower case body 200 is moved to the desired height, and the top stopping portion 312 is inserted into another upper locking hole 310 of the upper case body 300, so that the lower case body 200 and the upper case body 300 are connected together. The specific process is as follows:

After the button 41 is pressed, the connection base 411 on the back of the button 41 moves with the button 41 toward the housing cover 12, so that the hinge 44 on the connection base 411 rotates toward the middle of the button 41 to further pull down the pull rope 42. The thrust member 43 is pulled by the pull rope 42 to move down from the position adjacent to the top of the thrust opening 3111 to the bottom of the thrust opening 3111. At this time, the first spring 32 is further compressed, and the top stopping portion 312 of the locking pin 31 is retracted from the outer side of the receiving cavity 21 and is no longer inserted into the upper locking hole 310 of the upper case body 300, so that the upper case body 300 can move up and down relative to the lower case body 200. After the upper case body 300 moves relative to the lower case body 200 to the desired determined height, the top stopping portion 312 is inserted into another upper locking hole 310 of the upper case body 300 to complete the size adjustment of the suitcase.

The above only describes the preferred embodiments of the present invention, but the protection scope of the present invention is not limited to these embodiments. Any change or replacement that can be easily obtained by those skilled in the art within the technical scope disclosed by the present invention shall fall within the protection scope of the present invention. Therefore, the protection scope of the present invention shall be based on the protection scope of the claims.

What is claimed is:

1. A locking device, comprising a hollow housing, a locking base, a locking mechanism and a linkage mechanism, wherein the locking base is provided with a receiving cavity; the locking mechanism comprises a locking pin and a first spring, wherein the locking pin is arranged in the receiving cavity, and the first spring is arranged in the receiving cavity and abuts the locking pin; the linkage mechanism comprises a button, a pull rope and a thrust member, wherein the button is arranged on the hollow housing, a lower end of the pull rope is connected to the button, and an upper end of the pull rope is connected to the thrust member; and an end of the locking pin is retracted into or stretched out of the receiving cavity by the thrust member, wherein the locking base comprises a first base body and a second base body, wherein the first base body is provided with a mounting groove and a mounting hole, and the thrust member is arranged in the mounting groove; the upper end of the pull rope passes through the mounting hole and is then connected to the thrust member; a side of the first base body extends to form the second base body; the second base body is provided with the receiving cavity, and the receiving cavity is communicated with the mounting groove, wherein the locking pin comprises a pin body and a top stopping portion, wherein a top of the pin body is provided with a thrust opening, the thrust member abuts the thrust opening, and a side of the pin body extends to form the top stopping portion, wherein a cross-sectional shape of the thrust opening is triangular; a shape of a lower end of the thrust member is adapted to a shape of the thrust opening; sides of the thrust member extend respectively to form a second stopping piece and a connection portion; a side of the first base body is provided with a limiting groove, wherein the side of the first base body is adjacent to the second base body, and the second stopping piece moves in the limiting groove; the pull rope passes through the connection portion movably, and a top end of the pull rope is provided with an upper connection head.

2. The locking device according to claim 1, wherein a connection base is arranged on a back of the button, a hinge is rotatably arranged on the connection base, and the lower end of the pull rope is rotatably connected to the hinge.

3. The locking device according to claim 2, wherein an end portion of the lower end of the pull rope is provided with a lower connection head, and the lower connection head is rotatably connected to the hinge; the lower connection head is provided with a first stopping piece; an extension portion is formed on a side of the hollow housing, and the extension portion is provided with a groove communicated with an interior of the hollow housing; the groove is provided with a positioning groove in a length direction of the groove, the length direction of the groove is parallel to a long side of the hollow housing, and the lower connection head passes through the groove to allow the first stopping piece to move along the positioning groove.

4. The locking device according to claim 1, wherein sides of the first base body extend to form a plurality of second base bodies, and the first base body is provided with mounting grooves, wherein a number of mounting grooves corresponds to a number of second base bodies; the plurality of second base bodies are respectively provided with receiving cavities, and the receiving cavities are respectively communicated with the mounting grooves; locking pins and first springs are arranged in the receiving cavities; a number of thrust members corresponds to a number of second base bodies; connection portions of the thrust members are connected to form an integrated part, and the thrust members respectively abut thrust openings of the locking pins.

5. The locking device according to claim 1, wherein a front side of the hollow housing is provided with a mounting opening for mounting the button, and a rear side of the hollow housing is provided with a housing cover for closing the hollow housing; a plurality of columns are arranged in the hollow housing, and the housing cover is fixed on the plurality of columns.

6. A suitcase, comprising a lower case body, an upper case body and a locking device, the locking device comprising a hollow housing, a locking base, a locking mechanism and a linkage mechanism, wherein the locking base is provided with a receiving cavity; the locking mechanism comprises a locking pin and a first spring, wherein the locking pin is arranged in the receiving cavity, and the first spring is arranged in the receiving cavity and abuts the locking pin; the linkage mechanism comprises a button, a pull rope and a thrust member, wherein the button is arranged on the hollow housing, a lower end of the pull rope is connected to the button, and an upper end of the pull rope is connected to the thrust member; and an end of the locking pin is retracted into or stretched out of the receiving cavity by the thrust member, wherein the lower case body is provided with a lower locking hole, and the upper case body is provided with at least two upper locking holes in a plane where the lower locking hole is located; the locking device is arranged on an inner side wall of the lower case body, and the locking pin of the locking device passes through the lower locking hole and then is inserted into one of the at least two upper locking holes to connect the lower case body and the upper case body together.

7. The suitcase according to claim 6, wherein a slide rail is arranged on the lower case body, and the slide rail is arranged along a height direction of the lower case body; a slider is arranged on an inner side of the upper case body, and the slider is adapted to the slide rail.

8. The suitcase according to claim 6, wherein a connection base is arranged on a back of the button, a hinge is rotatably arranged on the connection base, and the lower end of the pull rope is rotatably connected to the hinge.

9. The suitcase according to claim 8, wherein an end portion of the lower end of the pull rope is provided with a lower connection head, and the lower connection head is rotatably connected to the hinge; the lower connection head is provided with a first stopping piece; an extension portion is formed on a side of the hollow housing, and the extension portion is provided with a groove communicated with an interior of the hollow housing; the groove is provided with a positioning groove in a length direction of the groove, and the lower connection head passes through the groove to allow the first stopping piece to move along the positioning groove.

10. The suitcase according to claim 6, wherein the locking base comprises a first base body and a second base body, wherein the first base body is provided with a mounting groove and a mounting hole, and the thrust member is arranged in the mounting groove; the upper end of the pull rope passes through the mounting hole and is then connected to the thrust member; a side of the first base body extends to form the second base body; the second base body is provided with the receiving cavity, and the receiving cavity is communicated with the mounting groove.

11. The suitcase according to claim 10, wherein the locking pin comprises a pin body and a top stopping portion, wherein a top of the pin body is provided with a thrust opening, the thrust member abuts the thrust opening, and a side of the pin body extends to form the top stopping portion.

12. The suitcase according to claim 11, wherein a cross-sectional shape of the thrust opening is triangular; a shape of a lower end of the thrust member is adapted to a shape of the thrust opening; sides of the thrust member extend respectively to form a second stopping piece and a connection portion; a side of the first base body is provided with a limiting groove, wherein the side of the first base body is adjacent to the second base body, and the second stopping piece moves in the limiting groove; the pull rope passes through the connection portion movably, and a top end of the pull rope is provided with an upper connection head.

13. The suitcase according to claim 12, wherein sides of the first base body extend to form a plurality of second base bodies, and the first base body is provided with mounting grooves, wherein a number of mounting grooves corresponds to a number of second base bodies; the plurality of second base bodies are respectively provided with receiving cavities, and the receiving cavities are respectively communicated with the mounting grooves; locking pins and first springs are arranged in the receiving cavities; a number of thrust members corresponds to a number of second base bodies; connection portions of the thrust members are connected to form an integrated part, and the thrust members respectively abut thrust openings of the locking pins.

14. The suitcase according to claim 6, wherein a front side of the hollow housing is provided with a mounting opening for mounting the button, and a rear side of the hollow housing is provided with a housing cover for closing the hollow housing; a plurality of columns are arranged in the hollow housing, and the housing cover is fixed on the plurality of columns.

* * * * *